US011290804B1

(12) United States Patent
Beavers

(10) Patent No.: US 11,290,804 B1
(45) Date of Patent: Mar. 29, 2022

(54) SOUND CONTROL EAR CUP, TINNITUS TREATMENT DEVICE, AND HEARING PROTECTION DEVICE

(71) Applicant: David Beavers, Colton, CA (US)

(72) Inventor: David Beavers, Colton, CA (US)

( * ) Notice: Subject to any disclaimer, the term of this patent is extended or adjusted under 35 U.S.C. 154(b) by 0 days.

(21) Appl. No.: 17/443,954

(22) Filed: Jul. 29, 2021

(51) Int. Cl.
*H04R 1/10* (2006.01)
*H04R 1/02* (2006.01)

(52) U.S. Cl.
CPC ..... *H04R 1/1058* (2013.01); *H04R 1/1008* (2013.01); *H04R 1/1083* (2013.01)

(58) Field of Classification Search
CPC . H04R 1/00; H04R 1/02; H04R 1/021; H04R 1/10; H04R 1/1008; H04R 1/1028; H04R 1/1058; H04R 1/1075; H04R 1/1083; H04R 2201/02; H04R 2201/025; H04R 2201/10
See application file for complete search history.

(56) References Cited

U.S. PATENT DOCUMENTS 9,807,493 B1 * 10/2017 Willis ..... A45F 5/00
2004/0197001 A1 * 10/2004 Terrell ..... H04R 1/1008 381/370
2011/0280423 A1 11/2011 Nielsen
2013/0343565 A1 * 12/2013 Ridler ..... H04R 1/1066 381/74
2015/0023515 A1 * 1/2015 Reimert ..... H04R 1/1083 381/71.6
2016/0360307 A1 * 12/2016 Willis ..... H04R 1/105
2017/0230744 A1 * 8/2017 Schrader ..... H04R 1/1083
2019/0238968 A1 * 8/2019 Hajati ..... H04R 1/1008
2020/0000406 A1 1/2020 Saidi
2021/0058693 A1 * 2/2021 Woelfl ..... H04R 1/1008

FOREIGN PATENT DOCUMENTS

GB 2577297 B 1/2021

* cited by examiner

*Primary Examiner* — Thang V Tran
(74) *Attorney, Agent, or Firm* — Carson Patents®; Gregory D Carson

(57) ABSTRACT

This invention is a Sound Control Ear Cup in the form of an externally fitted ear cupping device fitted to the contour of the ear for the ear for the purpose of reproducing a sound to acoustically cancel out another sound and enable sonic (active noise control) treatment of tinnitus while sleeping facing the side pressing an ear against a sleeping surface. The Sound Control Ear Cup can also be used to protect hearing and/or cancel out ambient sound noise. The tinnitus treatment device is a pair of sound control ear cups optionally held together with a headset or head-strap. The hearing protection device is a pair of sound control ear cups optionally held together with a headset or head-strap.

20 Claims, 5 Drawing Sheets

SOUND CONTROL EAR CUP, TINNITUS TREATMENT DEVICE, AND HEARING PROTECTION DEVICE

TECHNICAL FIELD OF THE INVENTION

This invention relates generally to a Sound Control Ear Cup, Tinnitus Treatment Device, or Hearing Protection Device in the form of an externally fitted ear cupping device for the ear for the purpose of reproducing a sound to acoustically cancel out another sound. This invention relates generally to a Sound Control Ear Cup, Tinnitus Treatment Device, or Hearing Protection Device in the form of an externally fitted ear cupping device for the ear for the purpose of reproducing a sound to acoustically cancel out another sound using active noise control.

This invention relates generally to a Sound Control Ear Cup, Tinnitus Treatment Device, or Hearing Protection Device in the form of an externally fitted ear cupping device for the ear for the purpose of reproducing a sound to acoustically cancel out another sound and protect the hearing of a user using active noise control.

This invention relates more specifically to a Sound Control Ear Cup, Tinnitus Treatment Device, or Hearing Protection Device in the form of an externally fitted ear cupping device fitted to the contour of the ear for the ear for the purpose of reproducing a sound to acoustically cancel out another sound and protect the hearing of a user using active noise control.

This invention relates more specifically to a Sound Control Ear Cup, Tinnitus Treatment Device, or Hearing Protection Device in the form of an externally fitted ear cupping device fitted to the contour of the ear for the purpose of reproducing a sound to acoustically cancel out another sound using active noise control.

This invention relates more specifically to a Sound Control Ear Cup, Tinnitus Treatment Device, or Hearing Protection Device in the form of an externally fitted ear cupping device fitted to the contour of the ear for the purpose of reproducing a sound to acoustically cancel out another sound and enable sonic treatment of tinnitus using active noise control.

BACKGROUND

Today there are devices available for producing a sound into an ear. There are various form factors of devices for producing a sound available. Examples of such devices include, but are not limited to the following: ear pieces, headphones, hearing aids, and speakers. Today there are devices available for protecting the ear. There are various form factors of devices for protecting the ear. Examples of such devices include, but are not limited to the following: ear cups, ear pieces, and headphones.

Today there are devices available for protecting the ear from a sound with active noise control. There are various form factors of devices for protecting the ear from a sound with active noise control available. Examples of such devices include, but are not limited to the following: ear cups, ear pieces, headphones, hearing aids, and speakers.

Today there are devices available for treating tinnitus with active noise control. There are various form factors of devices for treating tinnitus with active noise control available. Examples of such devices include, but are not limited to the following: ear cups, ear pieces, headphones, hearing aids, and speakers.

However, there are no sound control ear cups, hearing protection devices or tinnitus treatment devices currently available on the market that could be comfortably, safely, and effectively worn while sleeping, and particularly while resting with an ear pressed against a pillow or other surface. All of the existing devices have one or more structural features that make them uncomfortable and/or unsafe to wear while sleeping, particularly, while resting with an ear facing the sleeping surface due to the pressure exerted by the weight of the head on the ear while it is rested against the sleeping surface causing the device to poke or prod the wearer in and around the ear, dramatically reducing quality of sleep, causing injuries to the outer and/or inner ear structures and potentially leading to hearing loss. Additionally, any movement or shifting the head and ear along the sleeping surface dislodges the device, reducing the quality of an acoustic seal and delivered sound and often resulting in the treatment sound not being presented to the ear altogether.

Thus, there is a pressing need for a sound control ear cup, hearing protection device and a tinnitus treatment device that can be comfortably and effectively worn while sleeping or resting with an ear pressed against a pillow or other surface. Such device will enable a user to comfortably, effectively, and safely receive necessary tinnitus treatment and/or address and other existing hearing protection or sound control needs while resting in any and all desired positions, in particular in side-sleeping position, with an ear being pressed onto the surface.

According to a first aspect of the present invention, there is a sound control ear cup in the form of an ear cupping device comprising an ear retention ring, and a sound producing ear cup body having an inner and an outer surfaces, wherein the inner surface is facing the user when the sound control ear cup is being worn by the user and wherein said ear cup body and includes a power device, a sound generating device and an embedded sound control circuit, and wherein said ear retention ring is connectively attached to and fitted along a perimeter or at least to one of the surface areas located along the perimeter of said sound producing ear cup body and is operable to enclose an entirety of human ear within the ring and within the ear cup body for the purpose of protecting the ear from a sound with active noise control. In particular, the ear retention ring is operable to enable the entirety of the human ear (i.e. tragus, crus of helix, helix, lobule, auricle and tubercle) to pass through the retention ear ring opening and become entirely enclosed within the ear ring and within the ear cup body, while the retention ring is gently hugging the ear along the root of the auricle in posterior side of the ear and resting along the posterior portion of human face that is directly adjacent to an anterior ear side when ear is entirely enclosed within the sound control ear cup. In some implementations, the sound control circuit is being embedded within the ear cup body and/or within at least one surface of the ear cup body and is being operably and connectively attached to the power device and sound generating device.

According to a second aspect of the present invention there is a tinnitus treatment device comprising a first ear cupping device comprising a first ear retention ring, and a first sound producing ear cup body having a first inner and outer surfaces, wherein the first inner surface is facing the user when the first ear cupping device is being worn by the user and wherein the first ear cup body and includes a first power device, a first sound generating device and a first sound control circuit and wherein said first ear retention ring is connectively attached to and fitted along a perimeter or at least to one of the surface areas located along the perimeter of said first sound producing ear cup body and is operable to enclose an entirety of first human ear; and a second ear cupping device comprising a second ear retention ring, and a second sound producing ear cup body having a second inner and an outer surfaces, wherein the second inner surface is facing the user when the second sound control ear cup is being worn by the user and wherein said second ear cup device body and includes a second power device, a second sound generating device and a second sound control circuit, where said second ear retention ring is connectively attached to and fitted along a perimeter or at least to one of the surface areas along the perimeter of said second sound producing ear cup body and is operable to enclose an entirety of second human ear for the purpose of treating tinnitus with active noise control. In particular, the both (i.e. first and second) ear retention rings are equally operable to enable the entirety of the human ear (i.e. tragus, cruse of helix, helix, lobule, auricle and tubercle) to pass through the retention ear ring opening and become entirely enclosed within respective ear retention rings and ear cup bodies, while the retention ear rings are hugging the ears along the roots of the auricles in posterior sides of the ears and resting along the posterior portion of human face that is directly adjacent to an anterior ear sides when ears are entirely enclosed within the first and second ear cupping devices for the purpose of treating tinnitus with active noise control. In some implementations, first and second sound control circuits are being embedded within the respective first and second ear cup bodies and/or within at least one surfaces of the respective first and second ear cup bodies and are being operably and connectively attached to the respective first and second power devices and to respective first and second sound generating devices.

According to a third aspect of the present invention there is a hearing protection device comprising a first ear cupping device comprising a first ear retention ring, a first sound producing ear cup body having a first inner and outer surfaces, wherein the first inner surface is facing the user when the first ear cupping device is being worn by the user, wherein the first ear cup body and includes a first power device, a first sound generating device and a first sound control circuit, and wherein said first ear retention ring is connectively attached to and fitted along a perimeter or at least to one of the surface areas located along the perimeter of said first sound producing ear cup body and is operable to enclose an entirety of second human ear, and a second ear cupping device comprising a second ear retention ring, a second sound producing ear cup body having a second inner and an outer surfaces, wherein the second inner surface is facing the user when the second sound ear cupping device is being worn by the user and wherein said second ear cup body includes a second power device, a second sound generating device and a second sound control circuit and wherein said second ear retention ring is connectively attached to and fitted along a perimeter or at least to one of the surface areas located along the perimeter of said second sound producing ear cup body and is operable to enclose an entirety of second human ear for the purpose of protecting the ears with active noise control. In particular, the both (i.e. first and second) ear retention rings are operable to enable the entirety of the human ear (i.e. tragus, crus of helix, helix, lobule, auricle and tubercle) to pass through the retention ear ring openings and become entirely enclosed within respective ear retention rings and ear cup bodies, while the retention ear rings are hugging the ears along the roots of the auricles in posterior sides of the ears and resting along the posterior portions of human face that is directly adjacent to an anterior ear sides when ears are entirely enclosed within the first and the second ear cupping devices for the purpose of protecting the ears with active noise control. In some implementations, first and second sound control circuits are being embedded within the respective first and second ear cup bodies and/or within at least one surfaces of the respective first and second ear cup bodies and are being operably and connectively attached to the respective first and second power devices and to respective first and second sound generating devices.

An advantage of the sound control ear cup devices resides in the strategically engineered structure, comprising of structural components and materials that enable a wearer safely, effectively and comfortably experience one or more of the following: an active noise control, treatment of tinnitus, hearing protection while sleeping or resting on their side, back, or any other position resulting in the ear being pressed against a surface, as well as comfortably alternating between described resting and up-right position without discontinuation of one or more aforementioned experiences/benefits.

The invention will herein be described, by way of example only, with reference to the accompanying drawings. The figures represent some exemplary implementations. However, additional features/functionalities that are depicted are not to be considered to be entirely bound to the particular configuration and can be included in any combination in any other configuration of the ear cupping devices of the present invention. Furthermore, all shapes and dimensions of the devices and all its depicted features are not limiting and serve for an exemplary purpose only. The devices and all their features are not depicted to scale.

Figure 6A:
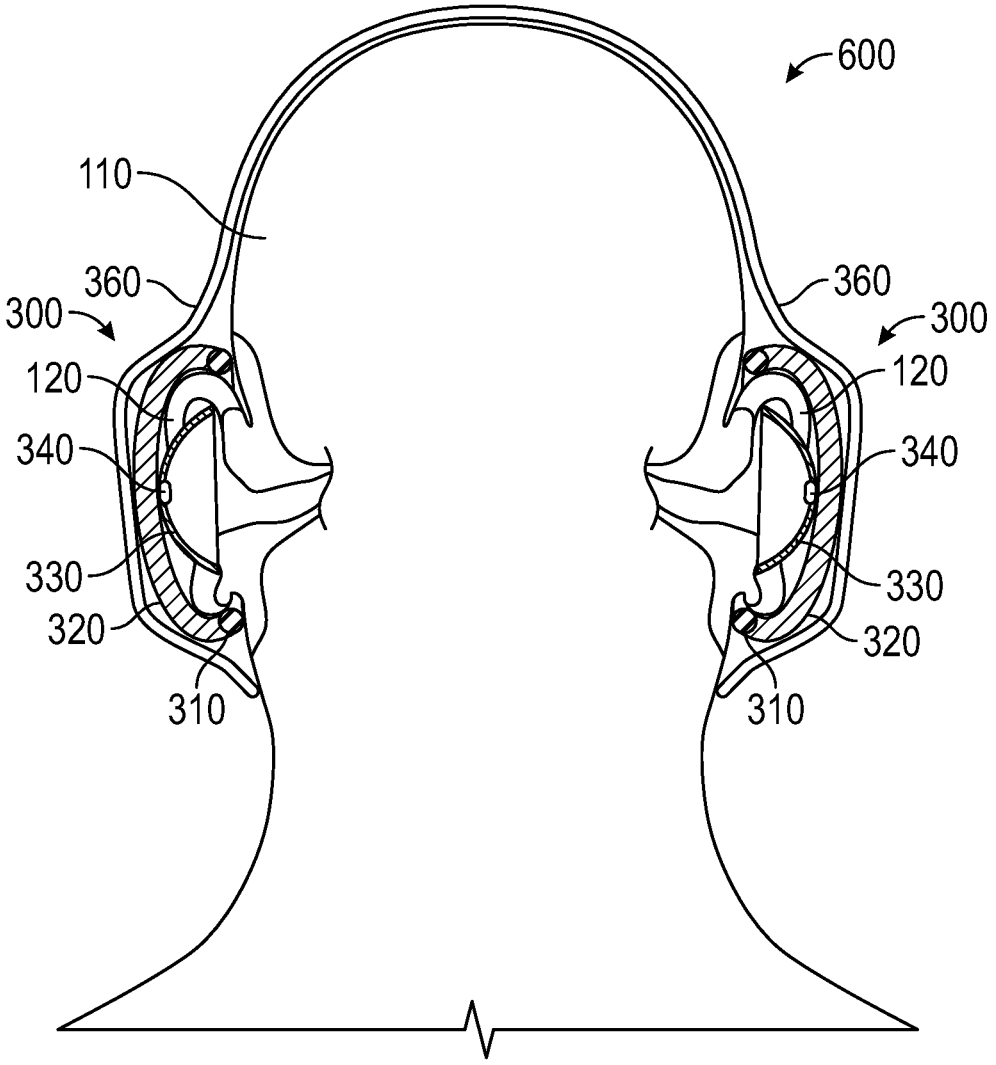
Figure 6B:
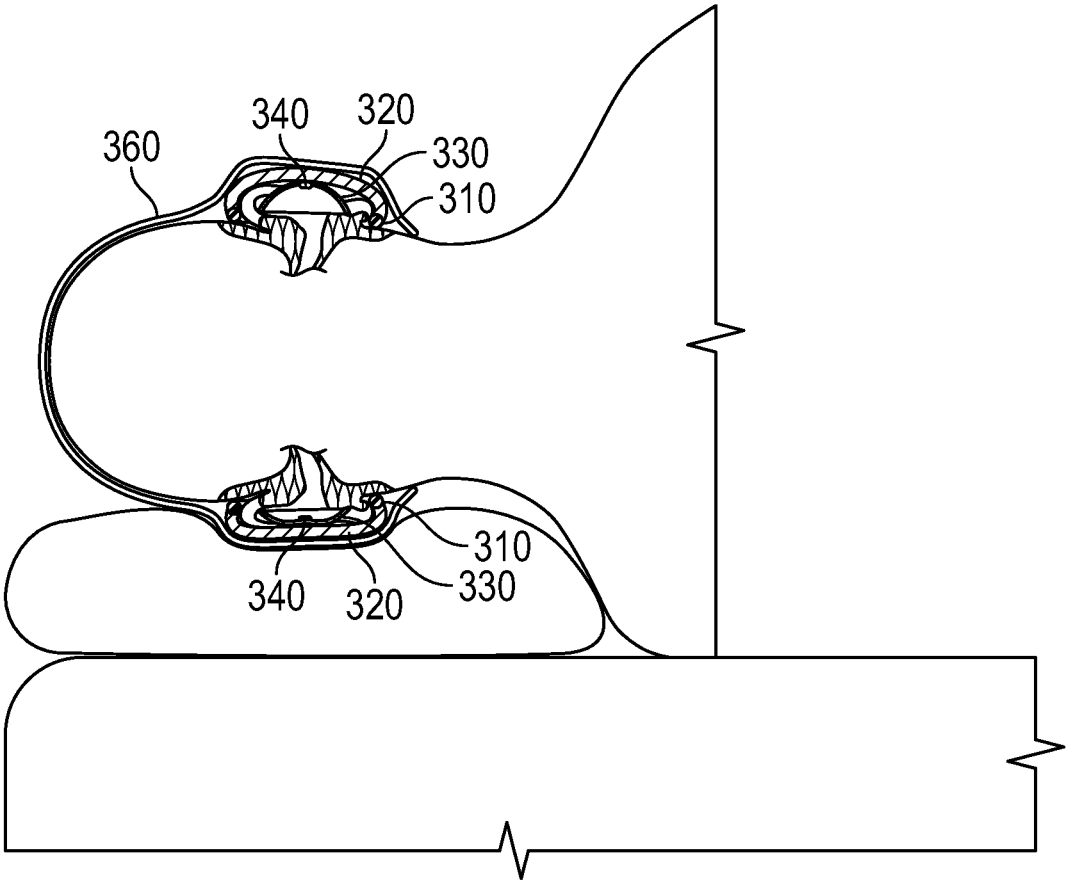

FIG. 6A is a cutaway schematic cross-sectional view showing the positioning of a sound control ear cups over both ears being held together by a headset (head-strap) such that the ear cups gently hug the ears over and around the external edges, i.e. enclosing an entirety of a user's ear according to some implementations. FIG. 6B is a schematic cross-sectional view showing a positioning of a sound control ear cups over both ears being held together by a headset (head-strap) such that the ear cups gently hug the ears over and around the external edges, enclosing an entirety of a user's ear according to some implementations, while user is resting in a side-sleeping position with an ear pressed against a surface.

DETAILED DESCRIPTION

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Throughout this specification, claims, and abstract the phrase "control circuits," or variations thereof, will be understood to imply, but not be limited to any electronic circuits and controls needed to enable and control of the following: the producing a sound through a speaker or sound generating device 340, the wireless communication with another wireless enabled device or apparatus, the charging of or transfer of power to a speaker or sound generating device 340.

Throughout this specification, claims, and abstract the phrase "active noise control," or variations thereof, will be understood to imply, but not be limited to protecting the ear from a first sound by producing a second sound in equal amplitude emitted as the antiphase of the first sound.

Index of Labelled Features in Figures. Features are listed in numeric order by Figure in numeric order.

Referring to the Figures, there are shown in the figures the following features/elements:

- Element 100 is an exemplary diagram showing the placement or relative position of the a sound control ear cup during use while a user is sleeping on the side pressing the ear down into a pillow.
- Element 110 is a head.
- Element 120 is an ear.
- Element 130 is a pillow.
- Element 140 is a mattress.
- Element 200 is a diagram showing the positioning or placement of a sound control ear cup around an ear, wherein said cup encloses an entirety of the ear.
- Element 300 is a perspective view of a sound control ear cup, wherein the perspective view depicts the sound control cup with the inner surface facing the viewer.
- Element 310 is an ear retention ring.
- Element 320 is sound producing ear cup body.
- Element 330 is a power device.
- Element 340 is a sound generating device.
- Element 350 is a control circuit shown embedded in sound producing ear cup device body 320.
- Element 360 is a headset or head-strap.
- Element 600 depicts a headset fitted comfortably to the head along with two attached ear cups operable for treating tinnitus and/or preventing an ear damage or discomfort from an ambient sound.

The sound control ear cup 300 comprises the ear retention ring 310 connectively attached to the sound producing cup body 320, wherein the ear cup body includes the power device 330, sound control circuit 350 and the sound generating device 340 attached or incorporated into said sound producing cup device body 320.

The ear retention ring 310 is comprising a tubular material where the material is being shaped in the general shape of an oval with a flattened end. The shape of the ear retention ring 310 can be an oval flattened on both ends, FIG. 3. The shape the ear retention ring 310 can be alternatively shaped in the general shape of an ear. The shape the ear retention ring 310 can be in the general shape of a right ear. The shape the ear retention ring 310 can be in the general shape of a left ear.

The shape the ear retention ring 310 can be customized to the shape of a specific ear including being fitted to the surface of said ear such that an inner edge gently hugs the ear. Any shape for the ear retention ring 310 can be constructed such that it has an inner edge that gently hugs the ear while it is worn by a person, wherein inclosing the entirety of the human ear. There can be many sizes of the ear retention ring 310 dimensioned to accommodate all sizes of human ears.

The sound producing cup body 320 comprises by attachment or incorporation the power device 330 and the sound generating device 340.

In some implementations, the sound producing cup body 320 includes the control circuits 350 to generate and control the sound for active noise cancellation from the sound generating device 340. In an alternate embodiment, the power device 330 includes the control circuits 350 to generate and control the sound for active noise cancellation from the sound generating device 340. In an embodiment, the control circuits needed to transfer power to the sound generating device 340 are present in the power device 330. In an alternative embodiment, the control circuits needed to transfer power to the sound generating device are present in the sound producing cup device body 320.

The sound producing cup body 320 can be a mold or injection formed ear cup using a rigid or semi-rigid (i.e. flexible) material. The amount of flexibility can be customized to personal preference. The sound producing ear cup body can be customized to accommodate various shaped, sizes, thicknesses of any human ear. Due to the aforementioned flexibility, ear cup device body is capable of being at least partially flattened and/or deformed upon application of compressive force directed substantially perpendicular to inner and/or outer surface(s) of the ear cup device body, thus forming at least partial acoustic seal around an entirety of the ear of the wearer when said wearer is resting in the side-sleeping position with the ear being pressed against a surface.

The sound producing cup body 320 can be of varying thickness to accommodate the connective attachment to or incorporation of the power device 330 and the sound generating device 340.

Figure 1:
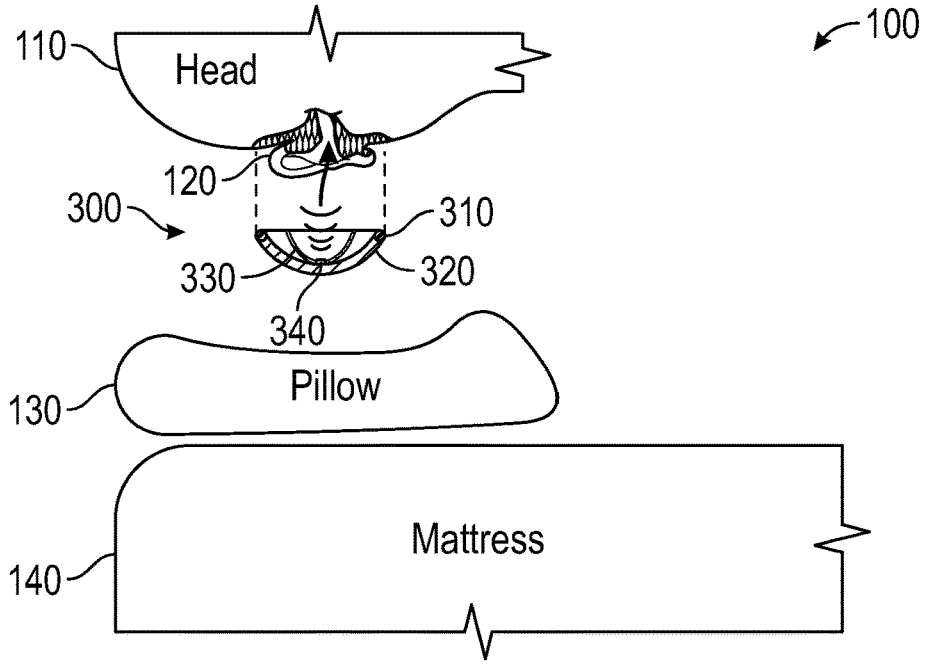
FIG. 1 is a schematic cross-sectional view of human head, sound control ear cup, pillow and mattress, depicting possible positioning of the sound control ear cup during use, i.e. between the head of a user and a pillow according to some implementations.
Figure 2:
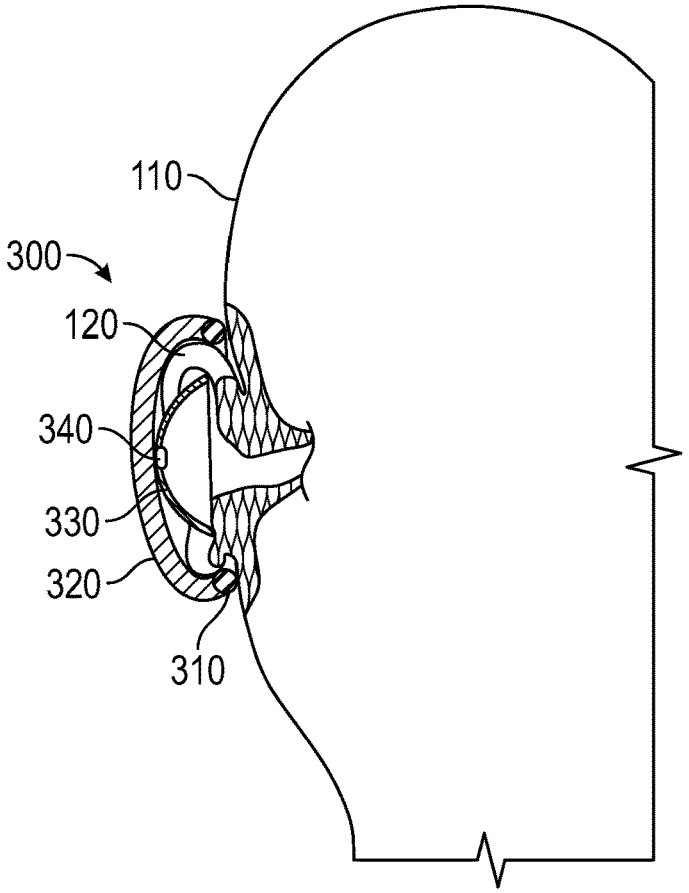
FIG. 2 is a schematic cross-sectional view showing a positioning of a sound control ear cup over and around the external edges of a user's ear i.e. enclosing an entirety of the ear according to some implementations.
Figure 3:
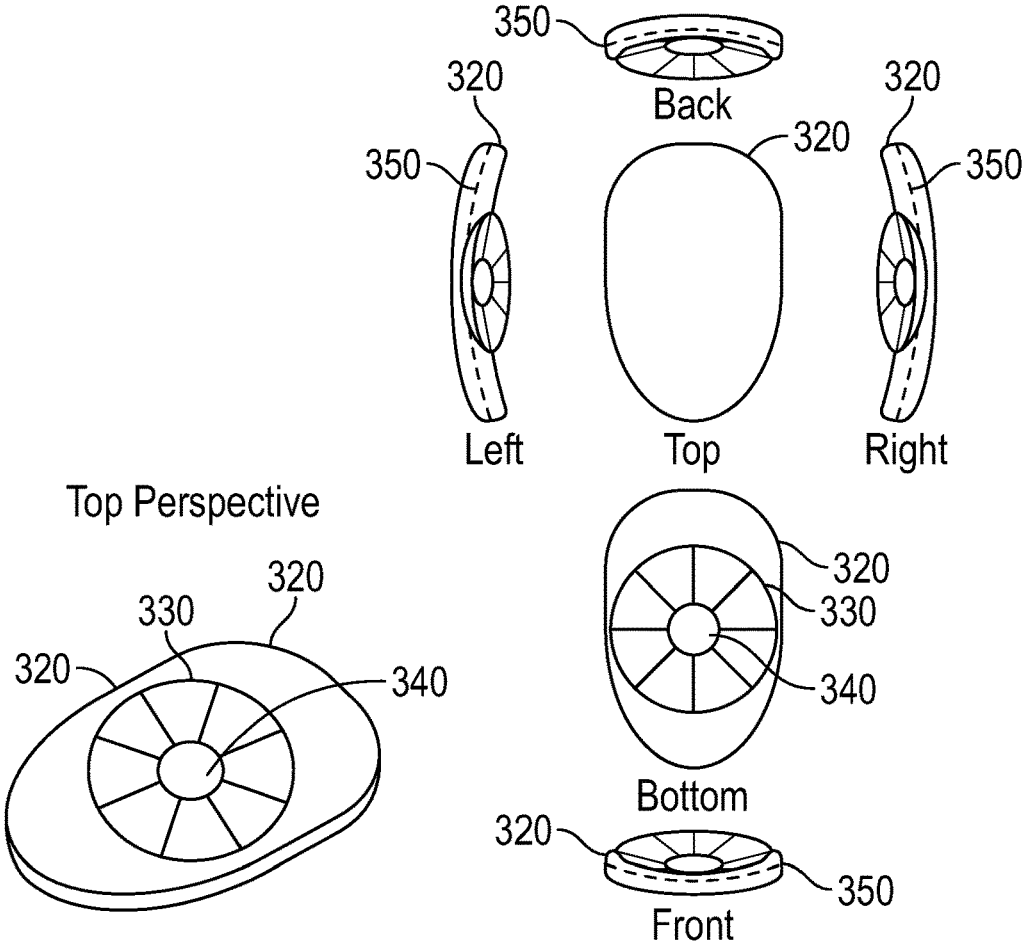
FIG. 3 shows a top perspective and six orthogonal views of the sound producing ear cup body according to some implementations and showing some elements of the sound control ear cup according to some implementations.
Figure 4:
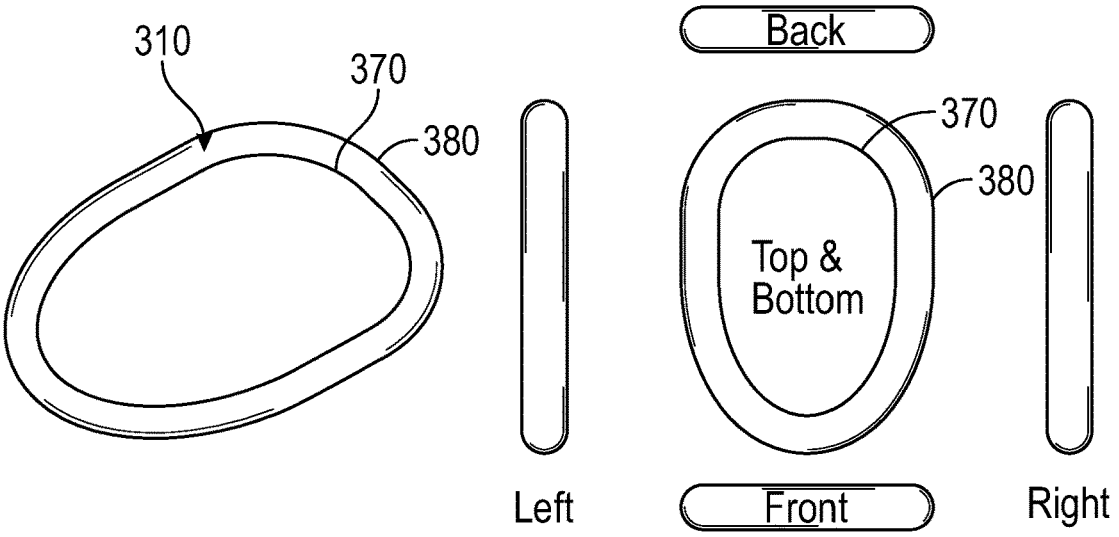
FIG. 4 shows a top (bottom) perspective and six orthogonal views of an ear retention ring showing the ring disconnected from the sound producing ear cup body according to some implementations, wherein element 370 is an inner edge of the ear retention ring and element 380 is an outer edge of the ear retention ring.
Figure 5:
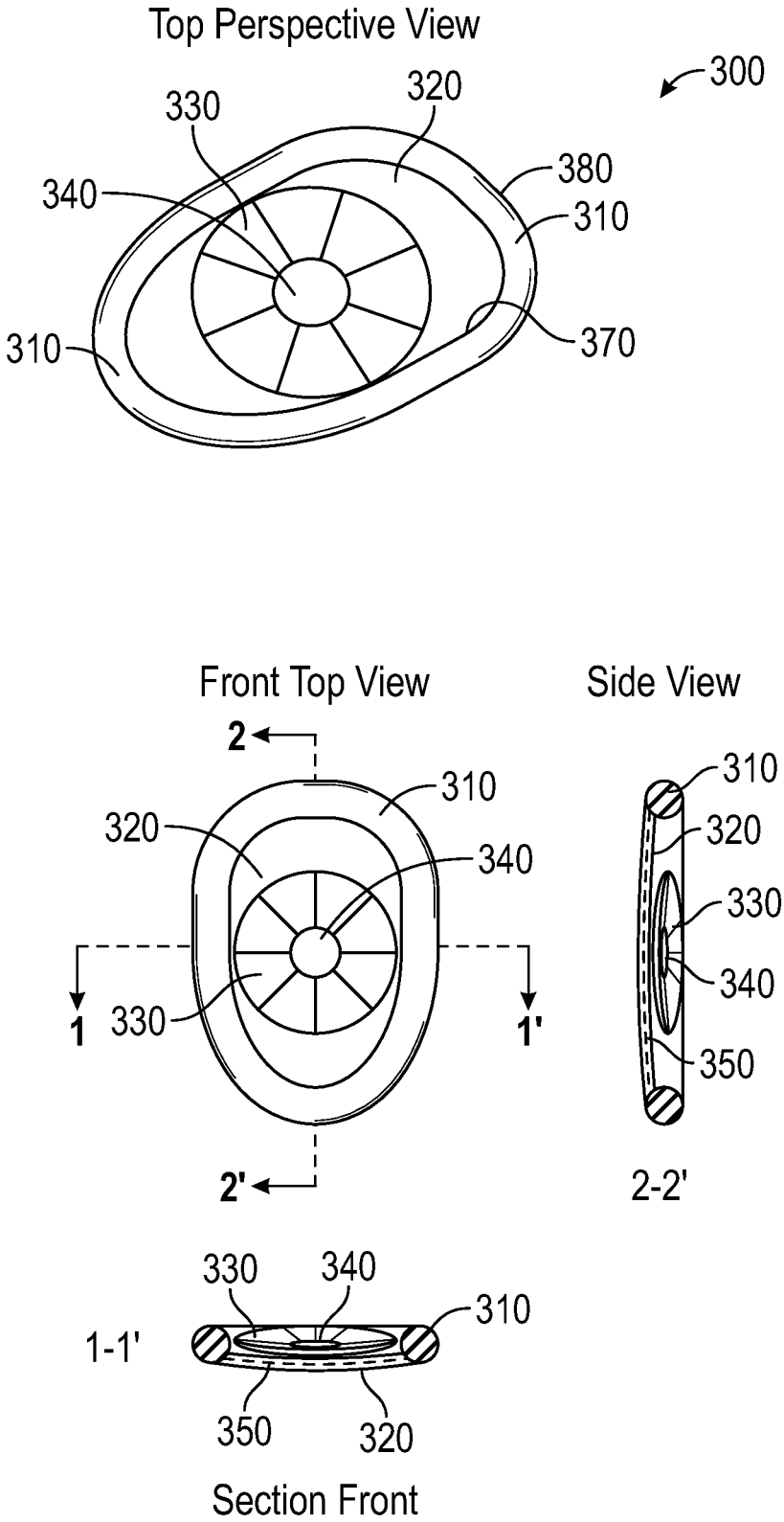
FIG. 5 shows a schematic perspective top view, front orthogonal view and two cross-sectional views of a sound control ear cup showing the elements of a sound control ear cup according to some implementations, wherein the front perspective and front views depicts the sound control cup with the inner surface facing the viewer.

The sound producing cup device body 320 can be comprised of an oval flattened on both ends as shown in FIG. 3. The sound producing cup device body 320 can be comprised of the general shape of an ear. The sound producing cup device body 320 can be comprised of the general shape of a right ear. The sound producing cup device body 320 can be comprised of the general shape of a left ear.

The sound producing cup device body 320 can be customized to the shape of a specific ear to include being fitted to the surface of said ear such that an inner surface gently hugs an entirety of the ear. Any shape for the sound producing cup device 320 can be constructed such that it has an inner surface that gently hugs an entirety of the ear while it is worn by a person. There can be many sizes of the sound producing cup device body 320 dimensioned to accommodate all sizes of human ears.

The power device 330 comprises a battery or electrical power connector to power the sound generating device 340. The power device 330 maybe comprised of a flexible surface power device having a battery and recharging capability. Due to the aforementioned flexibility, in some implementations, the power device 330 is being at least partially flattened and/or deformed upon application of compressive force directed substantially perpendicular to inner and/or outer surface(s) of the ear cup body, thus forming at least partial acoustic seal around an ear canal of the wearer when said wearer is resting in the side-sleeping position with the ear being pressed against a surface. In an embodiment, the power device 330 comprises the control circuits operable to transfer power to the sound generating device 340. In an embodiment, the sound producing cup device body 320 comprises the control circuits operable to transfer power and control the sound generating device 340.

The electrical power can be supplied through a connector to either power the device 330 or to a rechargeable battery therein. The electrical power connector is generally a thin flat profile to enable de minimus perception of its presence while worn by a user. Specifically, the electrical power connector is generally a thin flat profile to enable de minimus perception of its presence while worn by a user while sleeping. Thinner and lighter electrical connections are preferred over thicker implementations.

The control circuit 350, shown embedded in sound producing ear cup device body 320, is an assembly of the suitable components and electronics needed to receive a sound signal and then to generate a sound signal. Both rigid and flexible electronic circuits may be used. The thickness of the control circuits may vary. Furthermore, an assembled ear cupping devise in either rigid or flexible forms and preferred dimensions can fit comfortably outside or in the ear cavity without entering the ear canal.

The headset or head-strap 360, may be made from variety of materials, but is intended to be as unobtrusive and comfortable while worn for multiple hours. Any shape and dimensions suited to holding two ear cups a sufficient distance apart for wear by a person are possible. In the preferred embodiment, the headset is flat along the surface of the head between the ears, thin so as to be barely perceptible when worn, and can be worn for 8 or more hours of continuous use while sleeping with the head resting on a sleeping surface pressing the ear against the sleeping surface without disturbing the wearer by moving or becoming dislodged during use.

In some implementations, the headset fitted comfortably to the head with two attached ear cups operable for treating tinnitus of and/or prevention the user discomfort or ear damage from a sound. The element 600 may be implemented in any preferred or alternate embodiment.

In a preferred embodiment there is no external electrical power connector and as the power device 330 comprises a wirelessly rechargeable internal battery pack.

The sound generating device 340 can be any speaker, audio emitter, sonic emitter, or sound emitter capable of producing the range of sounds needed to counter a sound using active noise control. In an alternative embodiment, the sound generating device 340 includes the control circuits required for power transfer. In an alternative embodiment, the sound generating device 340 includes the control circuits needed to control the reproduction of the emitted sound.

To assemble a treatment device enabling a tinnitus treatment with active noise control for a person having two ears, two sound control ear cups 300 are required to be used in accord. The two sound control ear cups 300 can be attached by a headset or head-strap to securely hold the pair of sound control ears cups 300 against the ears of a wearer. In an embodiment, the headset or head-strap is comprised of a thickness similar to fabric used for clothing or bedding for maximizing wearer comfort. In an embodiment, the headset or head-strap is comprised of an ergonomic shape fitted to the top of the head. In an embodiment, the headset or head-strap is comprised of an ergonomic shape fitted to the back of the head.

In a preferred embodiment, there is no headset or head-strap and power device(s) 330 comprise a wirelessly rechargeable power pack. In a preferred embodiment, there is no headset or head-strap and the power device(s) 330 comprise a magnetically rechargeable power pack.

To assemble a hearing protection device for enabling a hearing protection with active noise control for a person having two ears, two sound control ear cups 300 are required to be used in accord. The two sound control ear cups 300 can be attached by a headset or head-strap to hold the pair of sound control ears cups 300 against the ears of a wearer.

In an embodiment, the headset or head-strap thickness is being similar to a thickness of a fabric used for clothing or bedding, while maximizing wearer comfort. In an embodiment, the headset or head-strap is comprised of an ergonomic shape fitted to the top of the head. In an embodiment, the headset or head-strap is comprised of an ergonomic shape fitted to the back of the head.

In a first preferred embodiment, there is a sound control ear cupping device 300 comprising flexible ear retention ring 310, a flexible sound producing ear cup body 320 comprising an embedded sound control circuit 350, a flexible power device 330, and a sound generating device 340, where said ear retention ring 310 is connectively attached to and fitted along a perimeter or at least to one of the surface areas located along the perimeter of said flexible sound producing ear cup body 320 and is operable to enable an entirety of an ear to pass through the ring opening, and become enclosed within said ear ring and said ear cup body. As a result of the ring flexibility, it is capable to form at least partial acoustic seal around the ear, wherein said seal is additionally improves, when said ring is being compressed, e.g., when ear rests against the surface. In some implementations of the first preferred embodiment, the power device 330 may comprise a flexible structure having a concave and a convex surfaces, wherein the concave surface of the power device 330 is facing the ear when the ear cupping device 300 is being worn by the user and wherein the said concave surface of the power device 330 is capable of being at least partially flattened and/or deformed upon application of compressive force directed substantially perpendicular to inner and/or outer surface(s) of the ear cup body, thus forming at least partial acoustic seal around an ear canal of the wearer when said wearer is resting in the side-sleeping or other position with the ear being pressed against a surface. In some implementations of the first preferred embodiment, the flexible power device 330 comprises a cup shaped device with a circular perimeter having a concave and a convex surfaces, wherein said concave surface having a vertex area substantially located at the center of the curvature of the concave surface, wherein the vertex area is being functionally coupled to the sound generating device 340, wherein the sound generating device 340 is operable to deliver a sound to an ear canal. In some implementations of first preferred embodiment, an entirety of the ear cup body 320 is capable of being at least partially flattened and/or deformed upon application of compressive force directed substantially perpendicular to inner and/or outer surface(s) of the ear cup body 320, thus forming at least partial acoustic seal around an entirety of the ear of the wearer when said wearer is resting in the side-sleeping or other position with the ear being pressed against a surface. In some implementations of the first preferred embodiment, the control circuit 350 is flexible and thus is capable to at least partially conform to ear surface when compressed.

In an alternate embodiment of the first preferred embodiment, there is a sound control ear cupping device 300, wherein said ear retention ring further comprises an inner edge shaped to match the shape and contour of an ear.

In an alternate embodiment of the first preferred embodiment, there is a sound control ear cupping device 300 wherein said power device 330 further comprises a rechargeable battery to power said ear cupping device 300.

In a second preferred embodiment, there is a tinnitus treatment device comprising a first ear cupping device 300 comprising a first ear retention ring 310, a first flexible sound producing ear cup body 320, wherein the first flexible sound producing ear cup body 320 includes a first embedded sound control circuit 350, a first flexible power device 330, and a first sound generating device 340, wherein said first ear retention ring 310 is connectively attached to and fitted along a perimeter or at least to one of the surface areas located along the perimeter of said first sound producing flexible ear cup body 320 and is operable to enable an entirety of an ear to pass through the ring opening, and become enclosed within said ear ring and said ear cup body. As a result of the ring flexibility, it is capable to form at least partial acoustic seal around the ear, wherein said seal is additionally improves, when said ring is being compressed, e.g., when ear rests against the surface, and a second ear cupping device 300 comprising a second ear retention ring 310, a second flexible sound producing ear cup body 320, wherein the second flexible sound producing ear cup body 320 includes a second embedded sound control circuit 350, a second flexible power device 330, and a second sound generating device 340, wherein said second ear retention ring 310 is connectively attached to and fitted along a perimeter or at least to one of the surface areas located along the perimeter of said second sound producing flexible ear cup body 320 and is operable to enable an entirety of an ear to pass through the ring opening, and become enclosed within said ear ring and said ear cup body. As a result of the ring flexibility, it is capable to form at least partial acoustic seal around the ear, wherein said seal is additionally improves, when said ring is being compressed, e.g., when ear rests against the surface. In some implementations of the second preferred embodiment, the first and second power devices 330 may comprise flexible structures having a concave and a convex surfaces, wherein the concave surfaces of the power devices 330 are facing the ears of the user when the first and second ear cupping devices 300 are being worn by the user and wherein the concave surface of at least one power device 330 is capable of being at least partially flattened and/or deformed upon application of compressive force directed substantially perpendicular to inner and/or outer surface of at least one ear cup body 320, thus forming at least partial acoustic seal around ear canal of the wearer when said wearer is resting in the side-sleeping or other position with at least one of the ears being pressed against a surface. In some implementations of the second preferred embodiment, the first and the second flexible power devices 330 each respectively comprise a cup shaped device with a circular perimeter having a concave and a convex surfaces, wherein said concave surface having a vertex area substantially located at the center of the curvature of the concave surface, wherein said vertex area is being functionally coupled to the sound generating device 340, wherein the sound generating device 340 is operable to deliver a sound to an ear canal of the user. In some implementations of the second preferred embodiment, an entirety of at least one ear cup body 320 is capable of being at least partially flattened and/or deformed upon application of compressive force directed substantially perpendicular to inner and/or outer surface of at least one ear cup body 320, thus forming at least partial acoustic seal around an entirety of the ear(s) of the wearer when said wearer is resting in the side sleeping or other position with at least one ear being pressed against a surface. In some implementations of the second preferred embodiment, the control circuits 350 are flexible and thus is capable to at least partially conform to ear surfaces when compressed.

In an alternate embodiment of the second preferred embodiment, there is a tinnitus treatment device wherein said first ear retention ring 310 further comprises an inner edge shaped to match the shape and contour of an ear, and said second ear retention ring 310 further comprises an inner edge shaped to match the shape and contour of an ear.

In an alternate embodiment of the second preferred embodiment, there is a tinnitus treatment device wherein the first ear retention ring 310 further comprises the shape of a left ear, and the second ear retention ring 310 further comprises the shape of a right ear.

In an alternate embodiment of the second preferred embodiment, there is a tinnitus treatment device, wherein said first power device 330 further comprises a rechargeable battery to power said first ear cupping device 300, and said second power device 330 further comprises a rechargeable battery to power said second ear cupping device 300.

In an alternate embodiment of the second preferred embodiment, there is a tinnitus treatment device further comprising a headset device having two opposing ends connectively attached to said first ear cupping device and said second ear cupping device to hold them a distance apart. In some implementation of the second preferred embodiment there is a headset or a head strap that is operable to be permanently or optionally attached to the respective outer surfaces of the first and the second ear cup bodies 320, therein exerting gentle compression to the ear cup bodies 320 improving an acoustic seal around an entirety of the ears, further securing the tinnitus treatment device around the head of the wearer and enabling the wearer to receive said treatment while alternating between side sleeping/ resting and upright awake states. In some implementations of the second preferred embodiment, the headset is being capable of at least partial deformation, thus comfortably hugging at least part of a head and ear contours of the wearer when, worn in side sleeping or other position with the head being pressed against a surface, improving an acoustic seal around an entirety of the ears and further securing the tinnitus treatment device around the head of the wearer.

In an alternate embodiment of the second preferred embodiment, there is a tinnitus treatment device wherein said headset device further comprises a flexible and pliable material suited to comfortable wear by user.

In an alternate embodiment of the second preferred embodiment, there is a tinnitus treatment device wherein said headset device further comprises an ergonomic shape to match the shape and contour a head.

In a third preferred embodiment, there is a hearing protection device comprising a first ear cupping device 300 comprising a first ear retention ring 310, a first flexible sound producing ear cup body 320, wherein the first flexible sound producing ear cup body 320 includes a first embedded sound control circuit 350, a first flexible power device 330, and a first sound generating device 340, wherein said first ear retention ring 310 is connectively attached to and fitted along a perimeter or at least to one of the surface areas located along the perimeter of said first sound producing ear cup body 320 and is operable to enable an entirety of an ear to pass through the ring opening, and become enclosed within said ear ring and said ear cup body. As a result of the ring flexibility, it is capable to form at least partial acoustic seal around the ear, wherein said seal is additionally improves, when said ring is being compressed, e.g., when ear rests against the surface, and a second ear cupping device 300 comprising a second ear retention ring 310, a second flexible sound producing ear cup body 320, wherein the second flexible sound producing ear cup body 320 includes a second embedded sound control circuit 350, a second flexible power device 330, and a second sound generating device 340, wherein said second ear retention ring 310 is connectively attached to and fitted along a perimeter or at least to one of the surface areas located along the perimeter of said second sound producing flexible ear cup body 320 and is operable to enable an entirety of an ear to pass through the ring opening, and become enclosed within said ear ring and said ear cup body. As a result of the ring flexibility, it is capable to form at least partial acoustic seal around the ear, wherein said seal is additionally improves, when said ring is being compressed, e.g., when ear rests against the surface. In some implementations of the third preferred embodiment, the first and second power devices 330 may comprise flexible structures having a concave and a convex surfaces, wherein the concave surfaces of the power devices are facing the ears when the first and second ear cupping devices 300 are being worn by the user and wherein the concave surface of at least one power device 330 is capable of being at least partially flattened and/or deformed upon application of compressive force directed substantially perpendicular to inner and/or outer surface of at least one ear cup body 320, thus forming at least partial acoustic seal around ear canal of the wearer, when said wearer is resting in the side-sleeping or other position with the one of the ears being pressed against a surface. In some implementations of the third preferred embodiment, the first and the second flexible power devices each respectively comprise a cup shaped device with a circular perimeters having a concave and a convex surfaces, wherein said concave surface having a vertex area substantially located at the center of the curvature of the concave surface, wherein said vertex area is being functionally coupled to the sound generating device 340, wherein the sound generating device 340 is operable to deliver a sound to an ear canal of the user. In some implementations of the third preferred embodiment, an entirety of at least one ear cups body 320 is capable of being at least partially flattened and/or deformed upon application of compressive force directed substantially perpendicular to inner and/or outer surface of at least one ear cup body 320, thus forming at least partial acoustic seal around an entirety of the ear(s) of the wearer when said wearer is resting in the side-sleeping or other position with the ear being pressed against a surface. In some implementations of the third preferred embodiment, the control circuits 350 are flexible and thus is capable to at least partially conform to ear surfaces when compressed.

In an alternate embodiment of the third preferred embodiment, there is a hearing protection device wherein said first ear retention ring 310 further comprises an inner edge shaped to match the shape and contour of an ear, and said second ear retention ring 310 further comprises an inner edge shaped to match the shape and contour of an ear.

In an alternate embodiment of the third preferred embodiment, there is a hearing protection device wherein the first ear retention ring 310 further comprises the shape of a left ear, and the second ear retention ring 310 further comprises the shape of a right ear.

In an alternate embodiment of the third preferred embodiment, there is a hearing protection device wherein said first power device 330 further comprises a rechargeable battery to power the first ear cupping device 300, and said second power device 330 further comprises a rechargeable battery to power the second ear cupping device 300.

In an alternate embodiment of the third preferred embodiment, there is a hearing protection device further comprising a headset device having two opposing ends connectively attached to said first ear cupping device and said second ear cupping device to hold them a distance apart. In some implementation of the third preferred embodiment, there is a headset or a head strap that is operable to be attached to the respective outer surfaces of the first and the second ear cup bodies 320, therein exerting gentle compression to the ear cup bodies 320 and further improving an acoustic seal around an entirety of the ears, further securing the active noise control device around the head of the wearer and enabling the wearer to experience the noise controlled environment while alternating between side sleeping/resting and upright awake state. In an alternate embodiment of the third preferred embodiment, there is a hearing protection device wherein said headset device further comprises a flexible and pliable material suited to comfortable wear by user.

In an alternate embodiment of the third preferred embodiment, there is a hearing protection device wherein said headset device further comprises an ergonomic shape to match the shape and contour a head.

The usual or average ear length or sizes are approximately 6.5 cm for an adult male, and 5.9 cm for an adult female. Individual ear length may vary considerably. The usual or average ear lobe length or size is approximately 2.0 cm for both an adult male, and an adult female. Individual ear lobes may vary considerably.

In the preferred embodiment, the interior dimension of the ear retention ring 310 is shaped to match the size and contour of an ear of a wearer. It is made of a hollow or compressible (i.e., flexible) material that is soft to the touch and can be worn while sleeping for an extended time periods and may be comfortably and continuously worn for at least eight hours. To enhance a comfort and grip, the ear retention ring 310 may be made from a formed hollow tube of a rubbery or foamy material which is later may be covered with a fabric or other material to enhance a comfort of the ring surface when the ear cupping device/devices are being worn by the user.

In the preferred embodiment, the interior dimension of the ear retention ring 310 is dimensioned between 0.01 and 1.67 percent smaller in diameter, and/or length, and/or width than the ear of the wearer in order to enhance grip and holding strength, securing its position when being placed around the ear, surrounding the ear. In other words, the ear retention ring is just small enough than the ear of the user so as to hold itself in position once place around and ear. In an alternative embodiment, the interior dimension of the ear retention ring 310 is between 1.0 and 8.0 percent smaller in diameter, and/or length, and/or width than the ear of the user.

Herein, the invention has been described by examples only. Therefore, the foregoing is to be considered solely for the illustrative purposes of the principles and teachings of the invention. Furthermore, since numerous modifications and alterations may readily occur to those skilled in the art, it is not intended to limit the invention to the exact structure and function as shown and described herein, and accordingly, all suitable modifications and equivalents that may be resorted to fall within the scope of the claims.

Although the invention has been explained in relation to various embodiments, it is to be understood that many other possible modifications and variations can be made without departing from the spirit and scope of the invention.

In a context of the current disclosure, the term an "entirety of the human ear (s)" is used interchangeably with term an "entirety of the ear(s)" and refers at least anterior portion of the ear(s) refer to the portion of the ear that is proximal to users face and distal to the user's head and encompasses at least: tragus, crus of helix, helix, antihelix, auricle, lobule, auricle and tubercle and may additionally encompass some other parts of the external parts human ear anatomy, wherein said "external parts" include all features of the ear protruding above the head surface of the user. The schematic representation of posterior and anterior ear anatomy is depicted in FIG. 7A, B that are included to facilitate an understanding and appreciation of the current disclosure and claims.

The invention claimed is:

1. An ear cupping device, comprising a flexible ear cup body, said ear cup body comprising an inner and an outer surface, said inner surface enclosing an entirety of an ear when said ear cupping device is worn by a user, said flexible ear cup body is operable to being at least partially flattened and/or deformed upon application of a compressive force directed substantially perpendicular to said inner and/or outer surfaces of said flexible ear cup body forming at least partial acoustic seal around the ear canal of said user, a flexible ear retention ring, said ring is being connectively attached along a perimeter or at least to one of the surface areas located along said perimeter of said inner and/or outer surfaces of said ear cup body and defines an opening enabling an entirety of the ear to pass through the said opening and enabling an entirety of said ear being enclosed within said ear cupping device, a sound control circuit, said sound control circuit being embedded within said ear cup body and/or within at least one said surfaces of said ear cup body, a sound generating device, a flexible power device, said power device is facing said ear when said ear cupping device being worn by said user, said power device is operable of being at least partially flattened and/or deformed upon application of compressive force directed substantially perpendicular to inner and/or outer surface(s) of said ear cup body, thus forming at least partial acoustic seal around an ear canal of the user, wherein said flexible ear cup body comprising said flexible power device, said sound generating device and said sound control circuit, wherein said sound control circuit is being operably and connectively attached to said flexible power device and to said sound generating device, and wherein an entirety of said ear cupping device is operable of being at least partially flattened and/or deformed upon application of compressive force directed substantially perpendicular to inner and/or outer surface(s) of said ear cup body, thus forming at least partial acoustic seal around an ear canal of the user.

2. The device of claim 1 wherein said ear retention ring further comprises an inner edge and an outer edge, wherein said inner edge is shaped to match the shape and contour of an ear.

3. The device of claim 2 wherein said ear retention ring further comprises an outer edge tapered to rest flat against a head of user.

4. The device of claim 2, wherein said inner edge is dimensioned up to seven percent smaller than an ear enabling a secure grip upon said ear when said device is being worn.

5. The device of claim 1 wherein said power device further comprises a rechargeable battery to power said ear cupping device.

6. A device of claim 1, wherein said ear retention ring is made of rubbery or foamy material.

7. A device of claim 1, wherein said flexible power device comprises a concave and a convex surfaces, said concave surface having a vertex area, located substantially at a center of a curvature profile of said concave surface, said vertex area is being functionally coupled to said sound generating device, wherein said concave surface is facing said user and said sound generating device opposing an ear canal and is operable to deliver sound to said ear canal when said device is being worn.

8. An active noise control and/or tinnitus treatment device comprising a first ear cupping device and a second ear cupping device, said first ear cupping device, comprising:

a first flexible ear cup body, said ear cup body comprising an inner and an outer surfaces, said inner surface enclosing an entirety of an ear when said first ear cupping device is worn by a user, said first flexible ear cup body is operable to being at least partially flattened and/or deformed upon application of a compressive force directed substantially perpendicular to said inner and/or outer surfaces of said first flexible ear cup body forming at least partial acoustic seal around a first ear canal of said user, a first flexible ear retention ring, said ring is being connectively attached along a perimeter or at least to one of surface areas located along said perimeter of said inner and/or outer surfaces of said ear cup body and defines an opening enabling an entirety of the ear to pass through the said opening and enabling an entirety of said ear being enclosed within said first ear cupping device, a first sound control circuit, said sound control circuit being embedded within said first ear cup body and/or within at least one said surfaces of said first ear cup body, a first sound generating device, a first flexible power device, said power device is facing said ear when said ear cupping device being worn by said user, said power device is operable of being at least partially flattened and/or deformed upon application of compressive force directed substantially perpendicular to inner and/or outer surface(s) of said ear cup body, thus forming at least partial acoustic seal around an ear canal of the user, and said second ear cupping device, comprising:

a second flexible ear cup body, said ear cup body comprising an inner and an outer surfaces, said inner surface enclosing an entirety of an ear when said second ear cupping device is worn by a user, said second flexible ear cup body is operable to being at least partially flattened and/or deformed upon application of a compressive force directed substantially perpendicular to said inner and/or outer surfaces of said second flexible ear cup body forming at least partial acoustic seal around a second ear canal of said user, a second flexible ear retention ring, said ring is being connectively attached along a perimeter or at least to one of surface areas located along said perimeter of said inner and/or outer surfaces of said ear cup body and defines an opening enabling an entirety of the ear to pass through the said opening and enabling an entirety of said ear being enclosed within said second ear cupping device, a second sound control circuit, said sound control circuit being embedded within said second ear cup body and/or within at least one said surfaces of said second ear cup body, a second sound generating device, a second flexible power device, said power device is facing said ear when said ear cupping device being worn by said user, said power device is operable of being at least partially flattened and/or deformed upon application of compressive force directed substantially perpendicular to inner and/or outer surface(s) of said ear cup body, thus forming at least partial acoustic seal around an ear canal of the user, wherein said first and second flexible ear cup bodies each comprise said first and second flexible power devices, said first and second sound generating devices and said first and second sound control circuits respectively, wherein said first and second sound control circuits each is being operably and connectively attached to said first and second flexible power devices and to said first and second sound generating devices respectively, and wherein an entirety of at least one of said first and second ear cupping devices is operable of being at least partially flattened and/or deformed upon application of compressive force directed substantially perpendicular to at least one inner and/or outer surface(s) of said ear cup body, thus forming at least partial acoustic seal around at least one ear canal of the user.

9. The device of claim 8 wherein said first and second ear retention rings each further comprise an inner edge and an outer edge, wherein said inner edge is shaped to match the shape and contour of an ear.

10. The device of claim 9, wherein said first ear retention ring further comprises the shape of a left ear, and the second ear retention ring further comprises the shape of a right ear.

11. The device of claim 9, wherein said first and second ear retention rings each further comprise an outer edge tapered to rest flat a head of the user.

12. The deice of claim 9, wherein said each inner edge of said first and second ear retention rings is dimensioned up to seven percent smaller than an ear enabling a secure grip upon said ear when said device is being worn.

13. The device of claim 8, wherein said first power device further comprises a rechargeable battery to power said ear cupping device and said second power device further comprises a recharge-able battery to power said ear cupping device.

14. The device of claim 8, further comprising a headset structure having opposing first and second ends, wherein said first end is being connectively attached to said first ear cupping device and said second end is being connectively attached to said second ear cupping device to hold said first and second ear cupping devices a distance apart.

15. The device of claim 14, wherein said headset structure further comprises a flexible and pliable material suited for comfortable wear by user.

16. The device of claim 14, wherein said headset structure further comprises an ergonomic shape matching a shape and contour a head.

17. The device of claim 8, wherein said device is enabled to produce a therapeutic sound for the treatment of tinnitus.

18. The device of claim 8, wherein said device is enabled to produce an ambient sound for the prevention of hearing damage.

19. A device of claim 8, wherein both ear retention rings are made of rubbery or foamy material.

20. A device of claim 8, wherein said first and second flexible power devices each comprise a concave and a convex surface, said concave surfaces having a vertex area, located substantially at a center of a curvature profile of said concave surface, said vertex area is being functionally coupled to said sound generating device, wherein said concave surface is facing said user and said sound generating device opposing an ear canal and is operable to deliver sound to said ear canal when said device is being worn.

* * * * *